US005927297A

United States Patent [19]

Cooper

[11] Patent Number: 5,927,297

[45] Date of Patent: Jul. 27, 1999

[54] HAIR RESTRAINT SYSTEM

[76] Inventor: Rosemary Cooper, 7154 Crisp, Raytown, Mo. 64133

[21] Appl. No.: 09/012,639

[22] Filed: Jan. 23, 1998

[51] Int. Cl.[6] ..... A45D 8/04; A45D 8/40; A45D 8/12; A45D 24/34

[52] U.S. Cl. ..... 132/273; 132/274; 132/275; 132/213.1

[58] Field of Search ..... 132/273, 274, 132/275, 213.1, 214; 2/171.4, 183

[56] References Cited

U.S. PATENT DOCUMENTS

| | | | |
|---|---|---|---|
| 2,975,788 | 3/1961 | Ardelyan | 132/273 |
| 3,561,455 | 2/1971 | Gregg | 132/274 |
| 4,785,834 | 11/1988 | Gonzalez | 132/275 |
| 4,972,859 | 11/1990 | Noviello, Jr. et al. | 132/273 |
| 5,174,312 | 12/1992 | Adams | 132/273 |
| 5,379,782 | 1/1995 | Tabb | 132/275 |
| 5,499,638 | 3/1996 | Ripley | 132/273 |
| 5,655,224 | 8/1997 | Sears | 2/171 |
| 5,664,589 | 9/1997 | Black | 132/246 |

*Primary Examiner*—John J. Wilson
*Assistant Examiner*—Trang Doan
*Attorney, Agent, or Firm*—Joseph N. Breaux

[57] ABSTRACT

It is thus an object of the invention to provide a hair restraint system that is rapidly converted by the user between a pony tail wrap and an anti-slip head band.

A hair restraint system that includes an outer restraint assembly that is connectable to an inner restraint assembly. The outer restraint assembly includes an outer elastic ring layer, an inner tack ring layer formed on an inwardly facing surface of the outer elastic ring layer, and a plurality of spaced female snap halves with the female snap connecting portion oriented toward a ring center of a center ring opening defined by the outer restraint assembly. The inner restraint assembly includes an inner elastic ring that is sized to fit into the center ring opening defined by the outer restraint assembly and having spaced male snap halves each having the male snap connecting portion oriented away from an assembly center opening defined by the inner restraint assembly. The spaced male snap halves of the inner restraint assembly are positionable in registration with and connection to the spaced female snap halves of the outer restraint assembly such that the inner elastic ring covers the inner tack ring layer of the outer restraint assembly.

16 Claims, 2 Drawing Sheets

HAIR RESTRAINT SYSTEM

TECHNICAL FIELD

The present invention relates to hair restraining devices and more particularly to a hair restraint system that includes an outer restraint assembly that is connectable to an inner restraint assembly; the outer restraint assembly including an outer elastic ring layer, an inner tack ring layer formed on an inwardly facing surface of the outer elastic ring layer, and a plurality of spaced female snap halves with the female snap connecting portion oriented toward a ring center of a center ring opening defined by the outer restraint assembly; the inner restraint assembly including an inner elastic ring that is sized to fit into the center ring opening defined by the outer restraint assembly and having spaced male snap halves each having the male snap connecting portion oriented away from an assembly center opening defined by the inner restraint assembly; the spaced male snap halves of the inner restraint assembly being positionable in registration with and connection to the spaced female snap halves of the outer restraint assembly such that the inner elastic ring covers the inner tack ring layer of the outer restraint assembly.

BACKGROUND ART

It is often desirable, when engaged in sporting activities, to restrain the hair, such as with a head band, in order to improve performance. In addition, it is also often desirable to alter the method of restraining the hair, such as changing from a pony tail wrap to an anti-slip head band, either immediately before engaging in the sporting activity or immediately afterward.. It would be a benefit, therefore, to have a hair restraint system that could be rapidly converted by the user between a pony tail wrap and an anti-slip head band.

GENERAL SUMMARY DISCUSSION OF INVENTION

It is thus an object of the invention to provide a hair restraint system that is rapidly converted by the user between a pony tail wrap and an anti-slip head band.

It is a further object of the invention to provide a hair restraint system that includes an outer restraint assembly that is connectable to an inner restraint assembly; the outer restraint assembly including an outer elastic ring layer, an inner tack ring layer formed on an inwardly facing surface of the outer elastic ring layer, and a plurality of spaced female snap halves with the female snap connecting portion oriented toward a ring center of a center ring opening defined by the outer restraint assembly; the inner restraint assembly including an inner elastic ring that is sized to fit into the center ring opening defined by the outer restraint assembly and having spaced male snap halves each having the male snap connecting portion oriented away from an assembly center opening defined by the inner restraint assembly; the spaced male snap halves of the inner restraint assembly being positionable in registration with and connection to the spaced female snap halves of the outer restraint assembly such that the inner elastic ring covers the inner tack ring layer of the outer restraint assembly.

Accordingly, a hair restraint system is provided. The hair restraint system includes an outer restraint assembly that is connectable to an inner restraint assembly; the outer restraint assembly including an outer elastic ring layer, an inner tack ring layer formed on an inwardly facing surface of the outer elastic ring layer, and an outer fastening mechanism for connecting the outer restraint assembly to the inner restraint assembly. The outer fastening mechanism is preferably a plurality of spaced female snap halves with the female snap connecting portion oriented toward a ring center of a center ring opening defined by the outer restraint assembly. The inner restraint assembly includes an inner elastic ring that is sized to fit into the center ring opening defined by the outer restraint assembly and a inner ring fastening mechanism for securing the inner restraint assembly to the outer restraint assembly. The inner ring fastening mechanism is preferably a plurality of spaced male snap halves each having the male snap connecting portion oriented away from an assembly center opening defined by the inner restraint assembly. When the preferred spaced male and female snap halves are utilized, the spaced male snap halves of the inner restraint assembly are positioned in a manner to be positionable in registration with and connection to the spaced female snap halves of the outer restraint assembly such that the inner elastic ring covers the inner tack ring layer of the outer restraint assembly. Of course, the outer fastening mechanism can utilize a plurality of spaced male snap halves and the inner ring fastening mechanism can utilize a plurality of spaced female snap halves if desired. The tack ring layer is preferably formed from a tacky rubber or plastic material. The tack ring layer is preferably constructed from a porous or semi-porous tacky material to allow sweat to pass through the tacky layer during use. The outer elastic ring layer and the inner elastic ring are each preferably constructed from an elastic nylon material.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
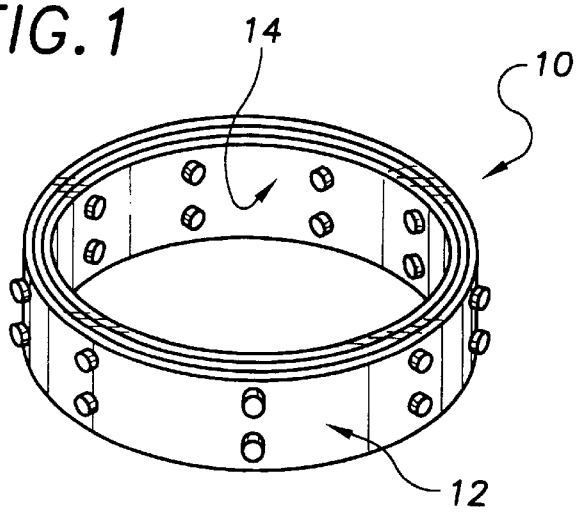
FIG. 1 is a perspective view of an exemplary embodiment of the hair restraint system of the present invention showing the exemplary outer restraint assembly connected to the exemplary inner restraint assembly.

FIG. 1 shows an exemplary embodiment of the hair restraint system of the present invention generally designated by the numeral 10. Hair restraint system 10 includes an outer restraint assembly, generally designated 12, and an inner restraint assembly, generally designated 14, that can each be used alone or that can be connected together for use.

Figure 2:
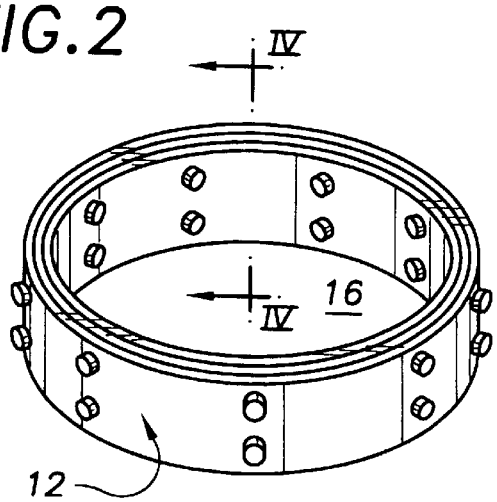
FIG. 2 is a perspective view of the exemplary outer restraint assembly of FIG. 1 in isolation showing the outer elastic ring layer, the inner tack ring layer, and the spaced female snap halves with the female snap connecting portion oriented toward the center opening of the outer restraint assembly.
Figure 3:
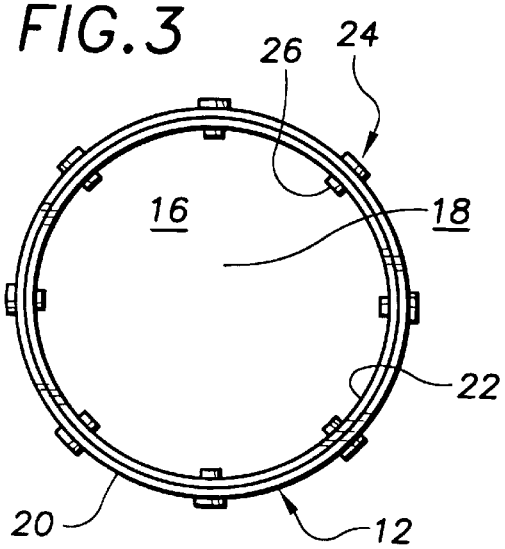
FIG. 3 is a top plan view of the outer restraint assembly of FIG. 2 showing the outer elastic ring layer, the inner tack ring layer, and the spaced female snap halves.
Figure 4:
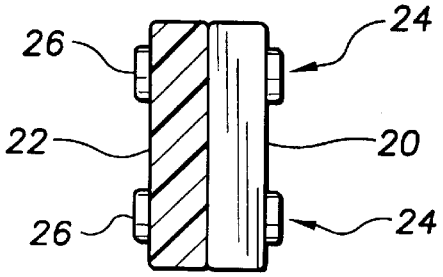
FIG. 4 is a cross sectional view of perspective view of the outer restraint assembly through the line IV—IV of FIG. 2 showing the outer elastic ring layer, the inner tack ring layer, and two of the spaced female snap halves.

With reference to FIG. 2, outer restraint assembly 12 is a closed elastic loop that defines a center ring opening 16 having a center 18 (FIG. 3). With continued reference to FIG. 3, outer restraint assembly 12 includes an outer elastic ring layer 20 formed from an elastic woven nylon material, an inner tack ring layer 22 formed from a semi-porous plastic material having a tacky surface that has been deposited onto an interior facing surface of outer elastic ring layer 20, and sixteen spaced female snap halves (eight along each edge), generally designated 24, each with a female snap connecting portion 26 that is oriented toward the center ring opening 16 of outer restraint assembly 12. With reference to FIG. 4, during construction inner tack ring layer 22 is deposited onto the interior facing surface of outer elastic ring layer 20, and the sixteen spaced female snap halves 24 are riveted through inner tack ring layer 22 and outer elastic ring layer 20 such that the female snap connecting portion 26 is positioned adjacent to inner tack ring layer 22.

Figure 5:
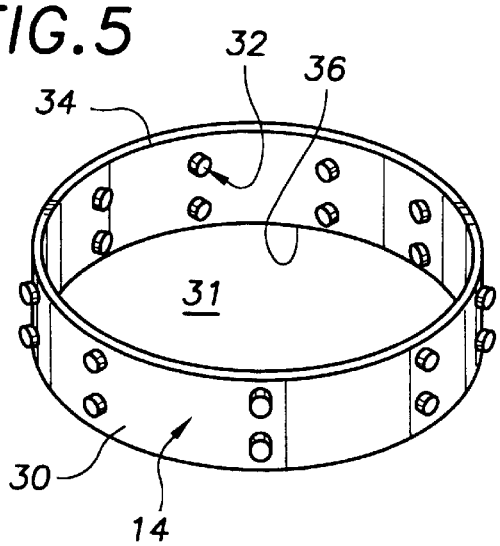
FIG. 5 is a perspective view of the exemplary inner restraint assembly of FIG. 1 in isolation showing the inner elastic ring and the spaced male snap halves with the male snap connecting portions oriented away from the center opening of the inner outer restraint assembly.
Figure 6:
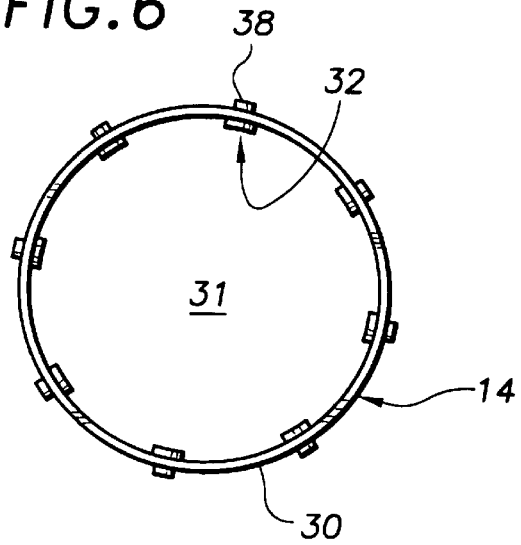
FIG. 6 is a top plan view of the inner restraint assembly of FIG. 5 showing the inner elastic ring and the spaced male snap halves with the male snap connecting portions oriented away from the center opening of the inner outer restraint assembly.

With reference now to FIG. 5, inner restraint assembly 14 includes an inner elastic ring 30 that defines an assembly center opening 31 and that is constructed of an elastic, woven nylon material. Sixteen spaced male snap halves, generally designated 32 are provided through inner elastic ring 30: eight along a top edge 34 and eight along a bottom side edge 36. Referring to FIG. 6, each male snap half 32 includes a male snap connecting portion 38 that is oriented away from assembly center opening 31.

Generally referring to FIGS. 1–6, in use, outer ring assembly 12 is used alone as an anti-slip headband by placing inner tack ring layer 22 in contact with the user. When it is desired to use hair restraint system 10 as a pony tail wrap, inner restraint assembly 14 is attached to outer restraint assembly 12 using male and female snap halves 32,26 and in a manner such that inner elastic ring 30 covers inner tack ring layer 22.

It can be seen from the preceding description that a hair restraint system has been provided that is rapidly converted by the user between a pony tail wrap and an anti-slip head band; and that includes an outer restraint assembly that is connectable to an inner restraint assembly; the outer restraint assembly including an outer elastic ring layer, an inner tack ring layer formed on an inwardly facing surface of the outer elastic ring layer, and a plurality of spaced female snap halves with the female snap connecting portion oriented toward a ring center of a center ring opening defined by the outer restraint assembly; the inner restraint assembly including an inner elastic ring that is sized to fit into the center ring opening defined by the outer restraint assembly and having spaced male snap halves each having the male snap connecting portion oriented away from an assembly center opening defined by the inner restraint assembly; the spaced male snap halves of the inner restraint assembly being positionable in registration with and connection to the spaced female snap halves of the outer restraint assembly such that the inner elastic ring covers the inner tack ring layer of the outer restraint assembly.

It is noted that the embodiment of the hair restraint system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A hair restraint system comprising:

an outer restraint assembly including an outer elastic ring layer, an inner tack ring layer formed on an inwardly facing surface of said outer elastic ring layer, and an outer fastening mechanism, said outer restraint assembly defining a center ring opening; and an inner restraint assembly including an inner elastic ring inside said center ring opening defined by said outer restraint assembly and a inner ring fastening mechanism, said inner restraint assembly defining an assembly center opening;

said outer fastening mechanism being removably engaged with said inner ring fastening mechanism to secure said inner restraint assembly to said outer restraint assembly such that said inner elastic ring covers said inner tack ring layer of said outer restraint assembly.

2. The hair restraint system of claim 1 wherein:

said tack ring layer is formed from a tacky rubber material.

3. The hair restraint system of claim 1 wherein:

said outer elastic ring layer and said inner elastic ring are each constructed from an elastic nylon material.

4. The hair restraint system of claim 1, wherein:

said outer fastening mechanism includes snap fastener halves each including a snap connecting portion oriented toward a ring center of said center ring opening defined by said outer restraint assembly.

5. The hair restraint system of claim 1, wherein:

said inner ring fastening mechanism includes a plurality of spaced snap halves each having a snap connecting portion oriented away from said assembly center opening defined by said inner restraint assembly.

6. The hair restraint system of claim 2 wherein:

said outer elastic ring layer and said inner elastic ring are each constructed from an elastic nylon material.

7. The hair restraint system of claim 2, wherein:

said outer fastening mechanism includes snap fastener halves each including a snap connecting portion oriented toward a ring center of said center ring opening defined by said outer restraint assembly.

8. The hair restraint system of claim 2, wherein:

said inner ring fastening mechanism includes a plurality of spaced snap halves each having a snap connecting portion oriented away from said assembly center opening defined by said inner restraint assembly.

9. The hair restraint system of claim 6, wherein:

said outer fastening mechanism includes snap fastener halves each including a snap connecting portion oriented toward a ring center of said center ring opening defined by said outer restraint assembly.

10. The hair restraint system of claim 6, wherein:

said inner ring fastening mechanism includes a plurality of spaced snap halves each having a snap connecting portion oriented away from said assembly center opening defined by said inner restraint assembly.

11. The hair restraint system of claim 9, wherein:

said inner ring fastening mechanism includes a plurality of spaced snap halves each having a snap connecting portion oriented away from said assembly center opening defined by said inner restraint assembly.

12. The hair restraint system of claim 7, wherein:

said inner ring fastening mechanism includes a plurality of spaced snap halves each having a snap connecting portion oriented away from said assembly center opening defined by said inner restraint assembly.

13. The hair restraint system of claim 3, wherein:

said outer fastening mechanism includes snap fastener halves each including a snap connecting portion oriented toward a ring center of said center ring opening defined by said outer restraint assembly.

14. The hair restraint system of claim 3, wherein:

said inner ring fastening mechanism includes a plurality of spaced snap halves each having a snap connecting portion oriented away from said assembly center opening defined by said inner restraint assembly.

15. The hair restraint system of claim 13, wherein:

said inner ring fastening mechanism includes a plurality of spaced snap halves each having a snap connecting portion oriented away from said assembly center opening defined by said inner restraint assembly.

16. The hair restraint system of claim 4, wherein:

said inner ring fastening mechanism includes a plurality of spaced snap halves each having a snap connecting portion oriented away from said assembly center opening defined by said inner restraint assembly.

* * * * *